US005810214A

United States Patent [19]

Hecht

[11] Patent Number: 5,810,214

[45] Date of Patent: Sep. 22, 1998

[54] METHOD AND DEVICE FOR BOW MAKING

[76] Inventor: David Hecht, 20 Church St., Greenwich, Conn. 06830

[21] Appl. No.: 764,594

[22] Filed: Dec. 11, 1996

[51] Int. Cl.[6] ..... A41H 43/00

[52] U.S. Cl. ..... 223/46; 28/147

[58] Field of Search ..... 223/46, 44; 28/147, 28/149, 150; 428/4, 5

[56] References Cited

U.S. PATENT DOCUMENTS

| | | | |
|---|---|---|---|
| 1,010,155 | 11/1911 | Lange | 223/46 |
| 2,569,943 | 10/1951 | Mitchell | 223/46 |
| 2,666,249 | 1/1954 | Ruiz et al. | 223/46 |
| 2,763,080 | 9/1956 | Welch | 28/147 |
| 3,501,070 | 3/1970 | Shattuck | 223/46 |
| 3,816,888 | 6/1974 | Rather, Jr. | 28/2 |
| 4,629,100 | 12/1986 | Owens | 223/46 |
| 4,714,182 | 12/1987 | Hecht | 223/46 |
| 5,094,370 | 3/1992 | Specht | 223/46 |
| 5,356,056 | 10/1994 | Teuten | 223/44 |
| 5,411,188 | 5/1995 | Teuten | 223/46 |
| 5,617,979 | 4/1997 | Cavender | 223/46 |

*Primary Examiner*—Amy B. Vanatta

[57] ABSTRACT

A simplified method and an apparatus for making bows comprises a base into which movable rods and fixed hoops are perpendicularly set whereupon a bow or other decoration may be made by winding ribbon or the like around the rods while retaining said ribbon between the hoops and then tying off the ribbon into a bow through the application of a tying means banded transversely and securely around the wound ribbon, whereupon said bow is removed from device and shaped into an aesthetically pleasing bow.

3 Claims, 11 Drawing Sheets

METHOD AND DEVICE FOR BOW MAKING

BACKGROUND OF THE INVENTION

The present invention relates to a method and a device which allows novices to learn in minutes and to become proficient shortly thereafter in the art of making bows out of ribbon and the like.

As used herein, the term "decorative bow" or "bow" will be understood to include any three dimensional structure resembling a bow of the type commonly used in packaging gifts, floral accessory decorations, and so on. Such structures commonly have the appearance of a bow tie or they may have a more complex structure. Typically, decorative bows are made up from lengths of ribbon material.

In prior art, earlier methods and devices have required a much higher level of training and dexterity on the part of operators. Decorative bows are made by hand by skilled people, or with the aid of a device or jig by both skilled and semi-skilled people. Unskilled or inexperienced people must first learn skills and master them prior to being enabled to make bows, with or without the aid of a device. This may take days, weeks or even months. And with prior art, some people can never achieve even rudimentary ability in the art of bowmaking.

Prior art is full of devices and patents which illustrate various methods and apparatus for forming a bow. It has been widely indicated that fabrication of bows is difficult for the novice. For instance, U.S. Pat. No. 1,307,069 entitled BOW OR TASSEL MAKING AND FORMING ATTACHMENT OR DEVICE issued on Jun. 17, 1919 to J. & W. Weismantel. This patent shows a device for making a bow and uses two elongated rods each having a pair of projecting fingers and which apparatus can make a bow with a larger outer and a smaller inner loop. In practice, this jig is cumbersome and difficult to use.

U.S. Pat. No. 2,077,370 entitled BOW FORMING APPARATUS issued on Apr. 13, 1937 to R. K. Reynolds. This patent shows a fixture which consists of two resilient arms positioned on a plate above a channel and is used to assist one in forming a bow.

U.S. Pat. No. 2,521,863 entitled BOW MAKING FIXTURE issued on Sep. 12, 1950 to H. E. Mertz and shows a fixture which consists of two curved arms and a center member around which fixture the ribbon is wound to form a bow.

U.S. Pat. No. 2,569,943 entitled BOW FORMING AND TYING JIG issued on Oct. 2, 1961 to J. W. Mitchell and shows a fixture which comprises three upstanding fingers above which the ribbon is oriented in forming a bow.

U.S. Pat. No. 4,410,113 entitled BOW FORMING APPARATUS issued on Oct. 18, 1983 to Robert Palombo. This patent shows a fixture which consists of two longitudinal projecting fingers above another pair of similar fingers separated by a predetermined amount and used to collect ribbon between them to aid in forming a bow.

SUMMARY OF THE INVENTION

Broadly, it is an object of the present invention to allow total novices, without any prior experience, to make professional quality bows of various styles with little effort or training through the use of a new method and a bowmaker device herein set forth.

This and other objects of the present invention are achieved with the present invention wherein a lightweight, inexpensive device is used in conjunction with an easy to learn and apply method, herein described.

A length of tie wire, which will be used to secure a bow, is placed on base of bowmaker. Then, a length of ribbon is wound around and around a pair of horizontally spaced vertical rods several times while being constrained within a pair of hoops which are parallel to each other and the rods. Rods are set by user to an appropriate spread to determine size of bow. The hoops act as an additional "hand" enabling even an inexperienced operator to manipulate a plurality of loops of ribbon which comprises the bow.) The bow is formed by pinching together the center of the plurality of the turns of ribbon and then bringing the tie wire around the center and twisting the tie wire to secure the assembly. Next the bow is slid off the jig and the bow loops are spread apart to shape into a pleasing form. By using this type of method and device, excellent bows can be produced by inexperienced people who could not otherwise produce a bow.

These and other objects and advantages of the present invention will be seen from the following detailed description of the invention.

BRIEF DESCRIPTION OF THE DRAWINGS

FIG. 1 is view of bowmaker showing placement of tie wire and first part of a length of ribbon.

FIG. 2 shows ribbon being wound around both rods while staying within hoops.

FIG. 3 shows additional ribbon being wound around both rods while staying within hoops.

FIG. 4 depicts adjusting and smoothing ribbon.

FIG. 5 depicts cutting ribbon after desired number of turns is completed.

FIG. 6 shows pinching together of center of bow and securing with tie wire.

FIG. 7 depicts twisting tightly for reliability during further handling of bow.

FIG. 8 shows bow being slid up and off rods.

FIG. 9 illustrates bow loops and tails being shaped into pleasing form.

FIG. 10 is a top view of bowmaker base.

FIG. 11 is a front view of bowmaker base.

FIG. 12 is a bottom view of bowmaker base.

FIG. 13 is a section A—A view of bowmaker base.

DETAILED DESCRIPTION OF THE INVENTION

Figure 1:
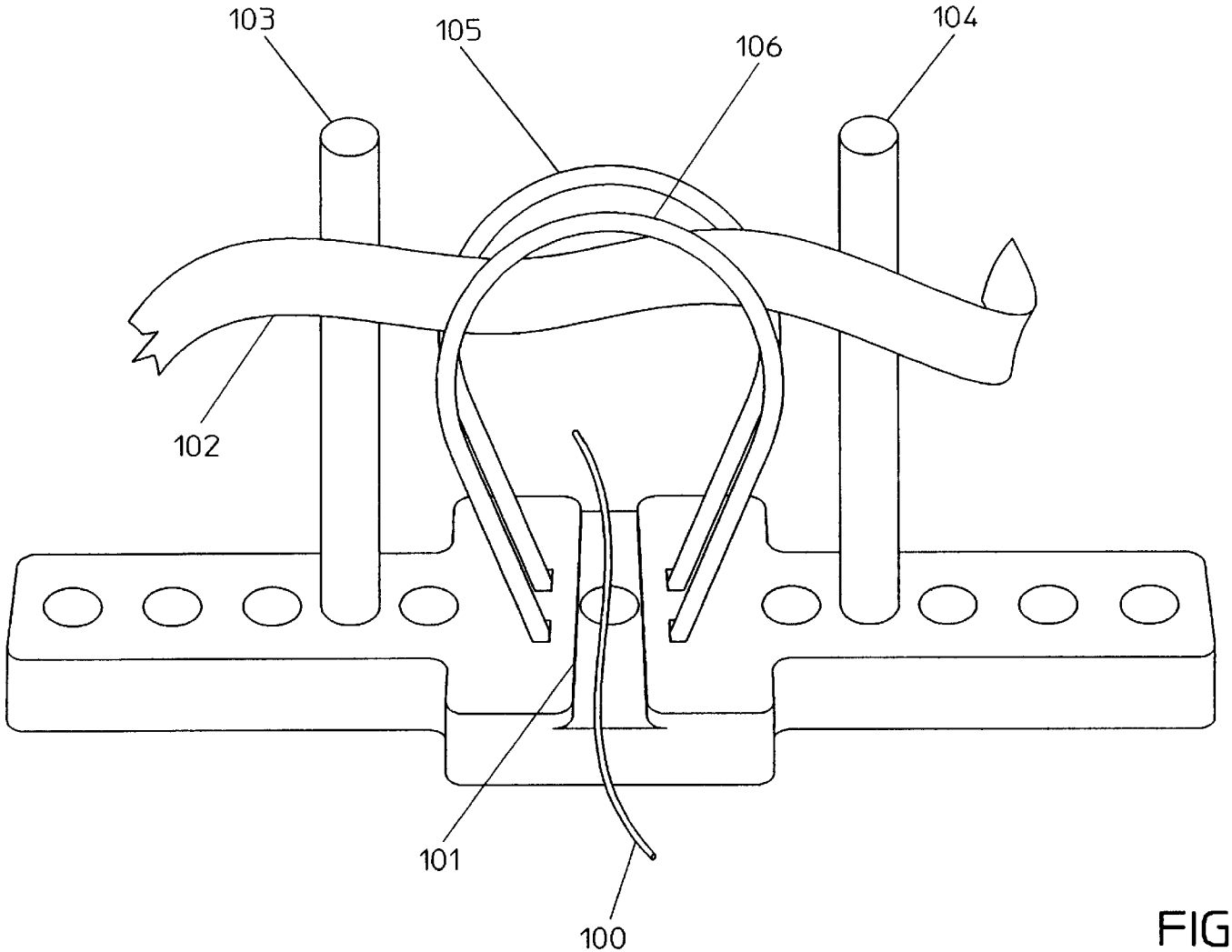
FIGS. 1 through 9 show the steps of making a bow utilizing the invention.
Figure 2:
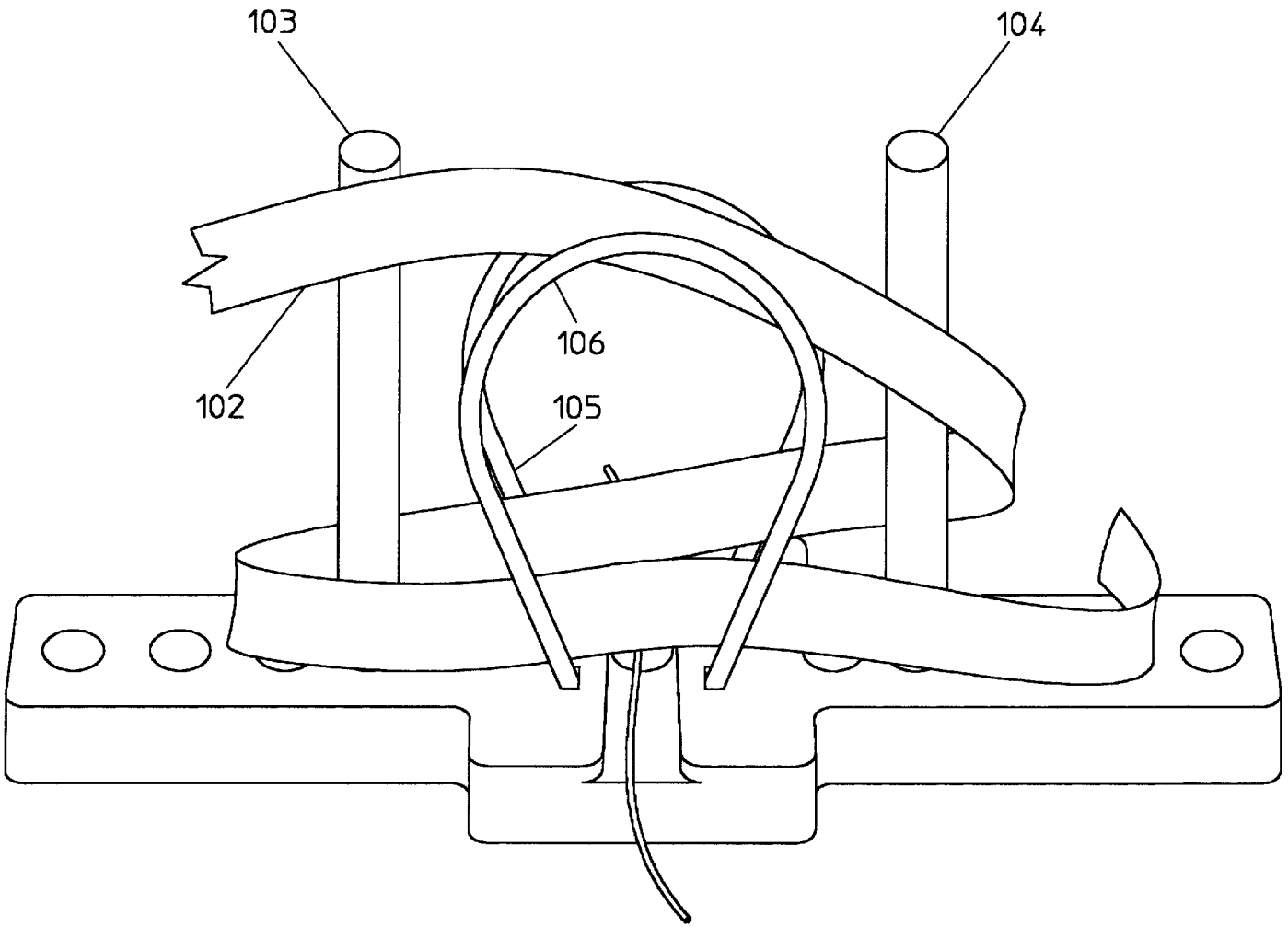
Figure 3:
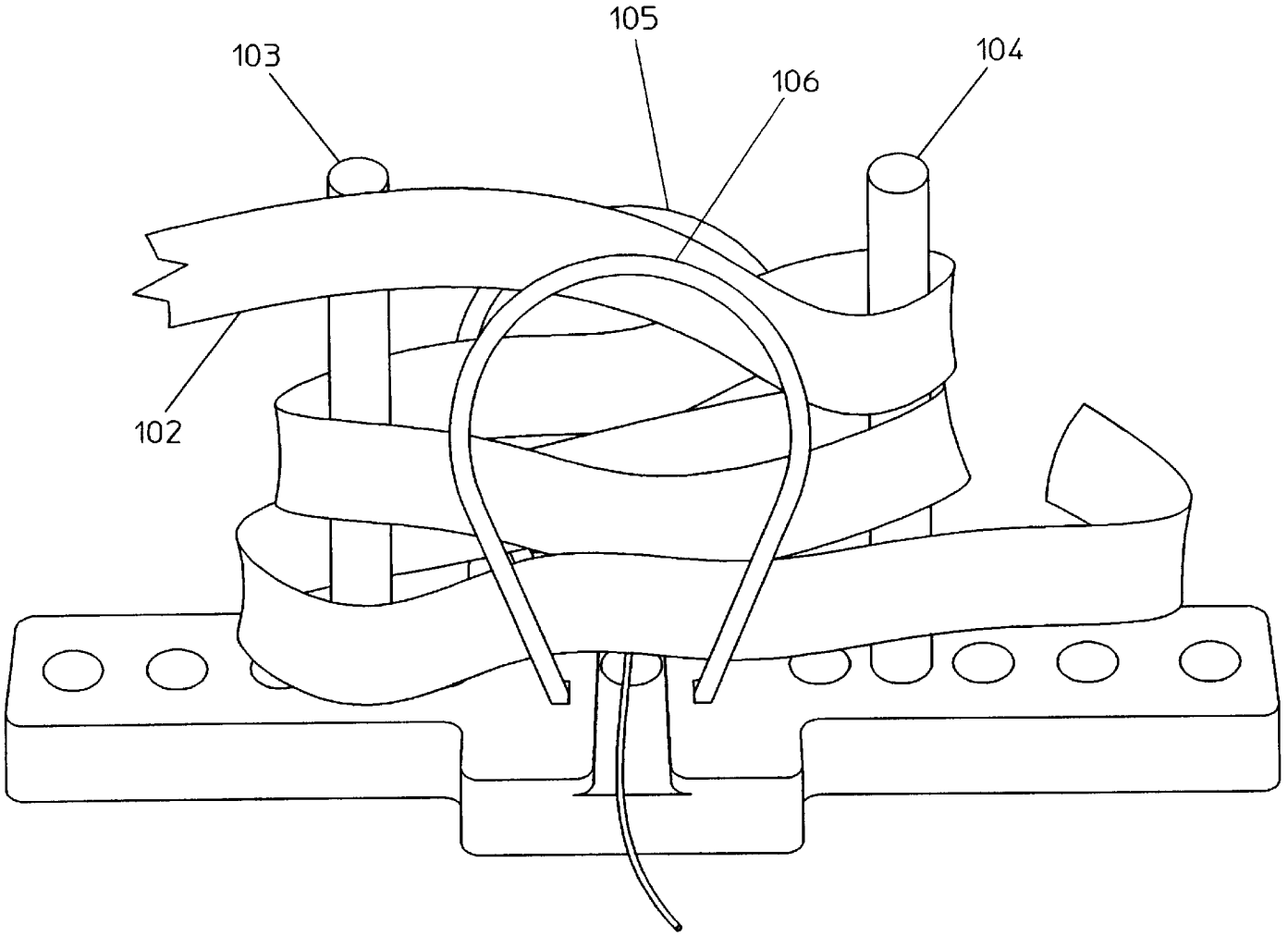
Figure 4:
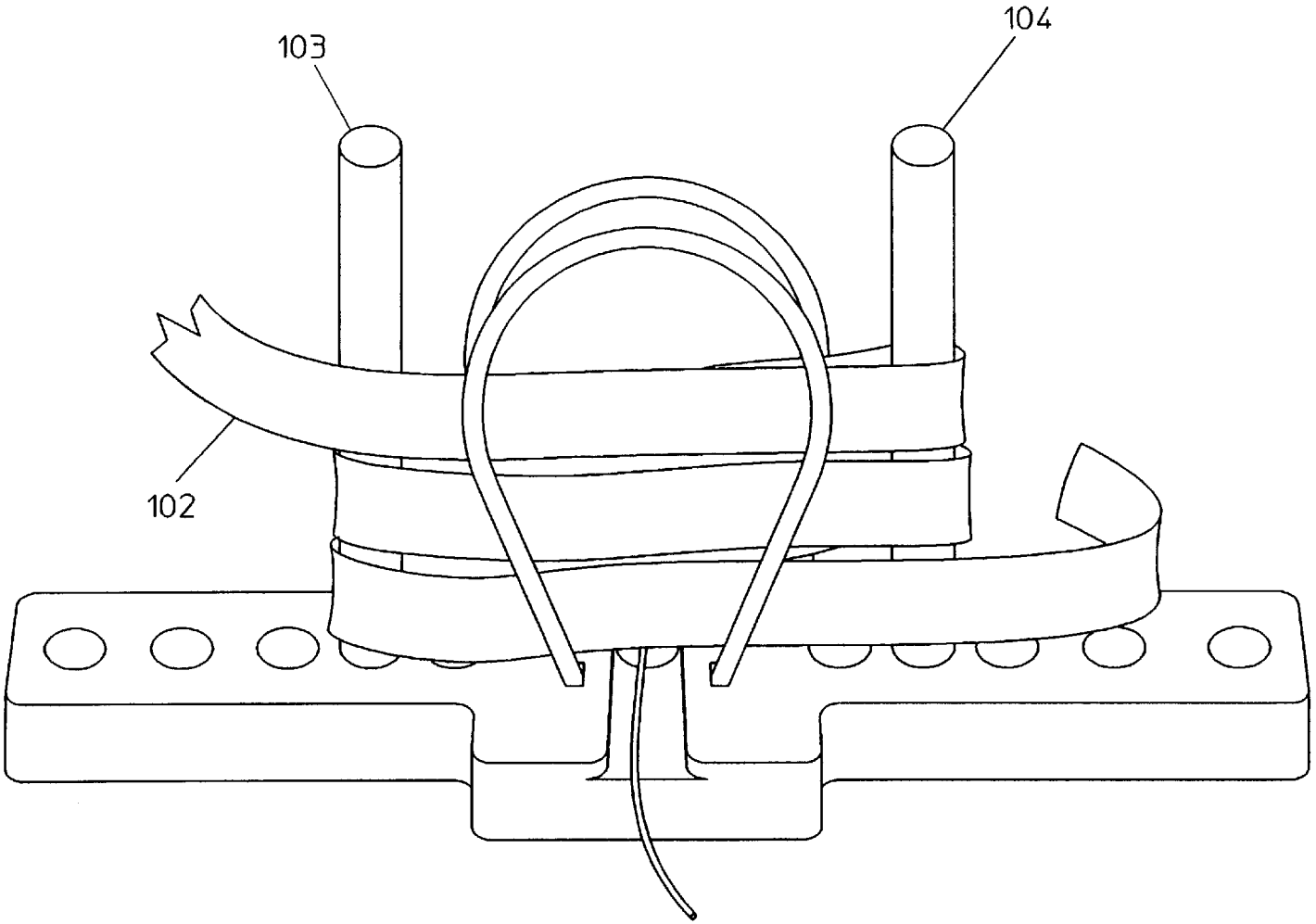
Figure 5:
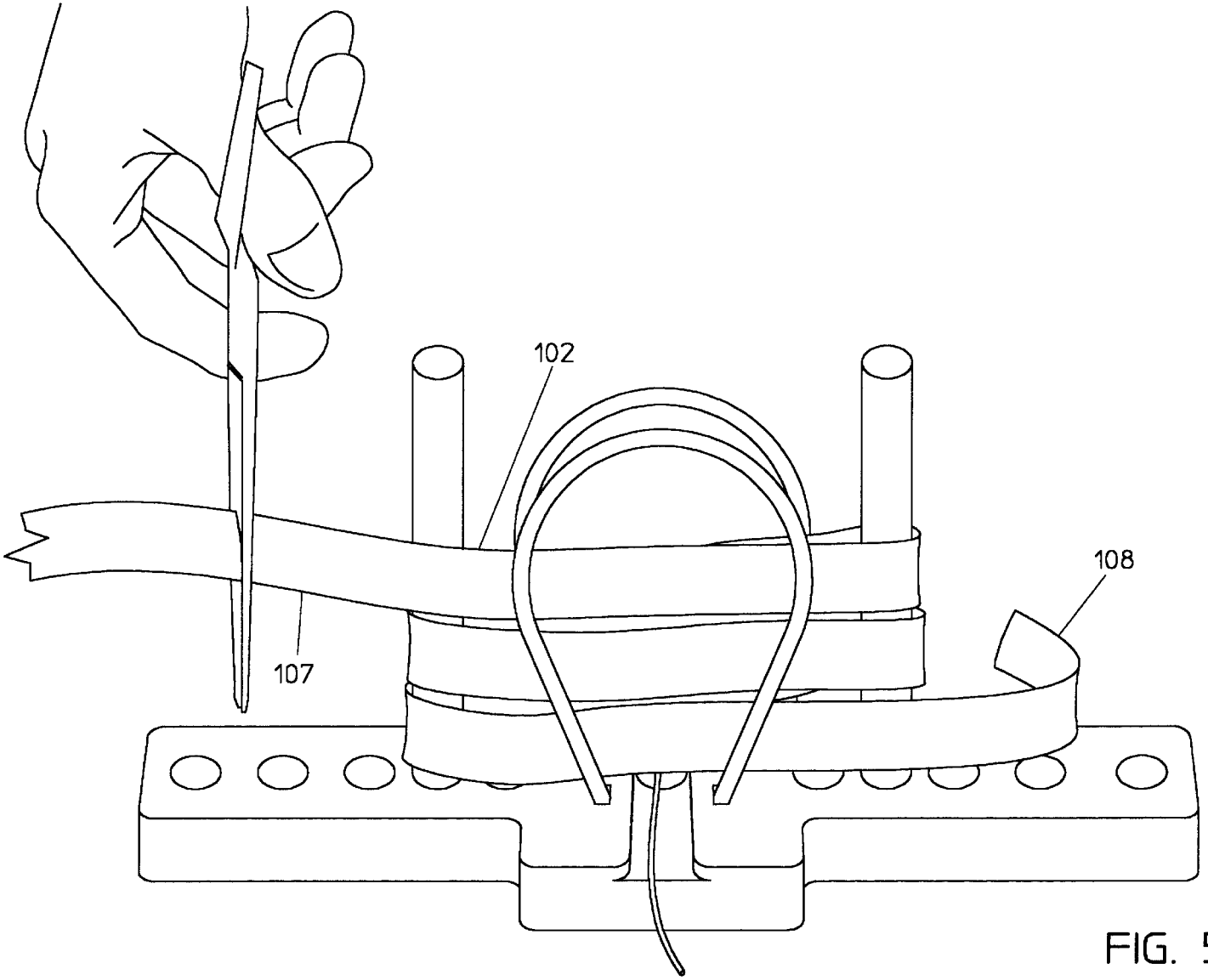
Figure 6:
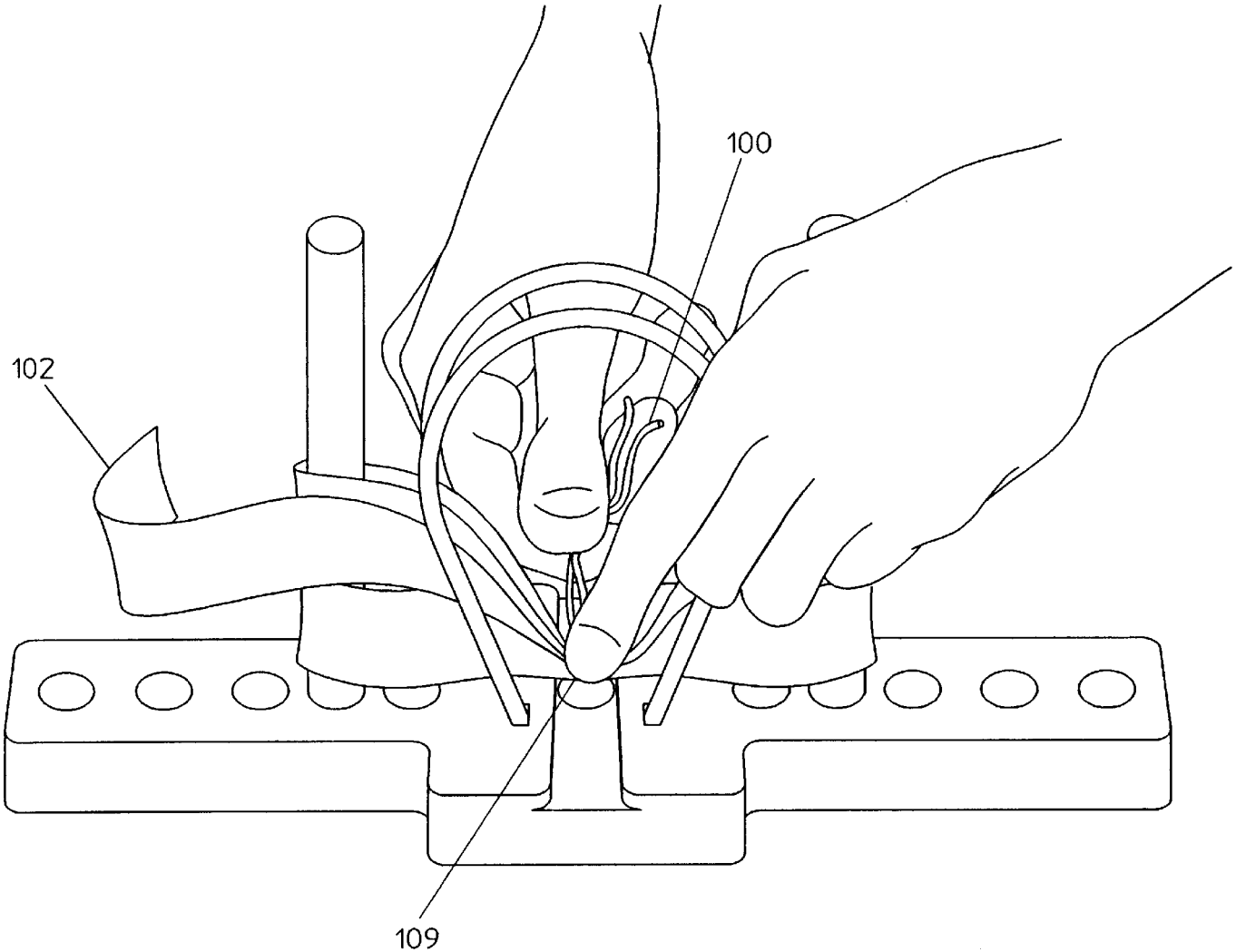
Figure 7:
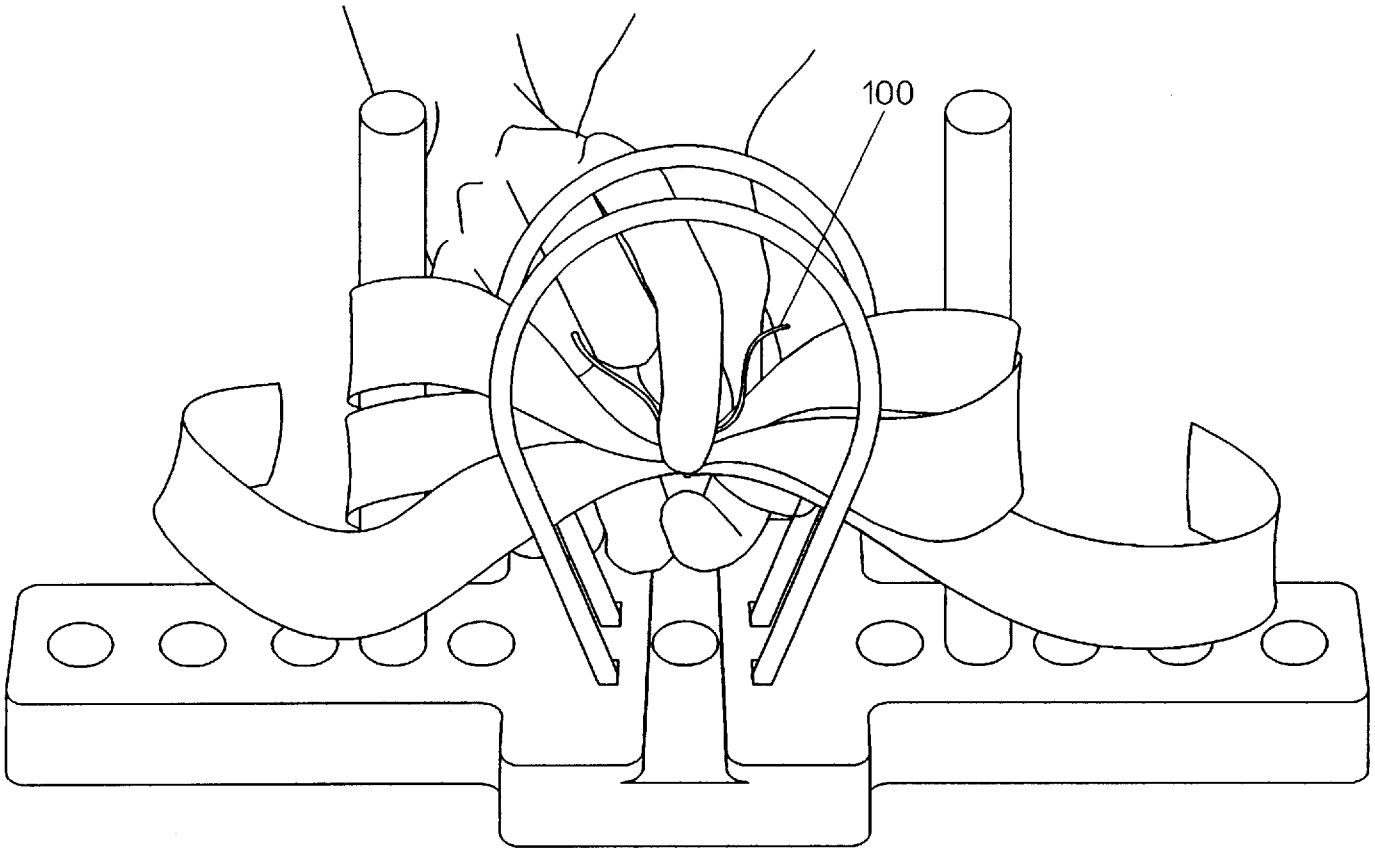
Figure 8:
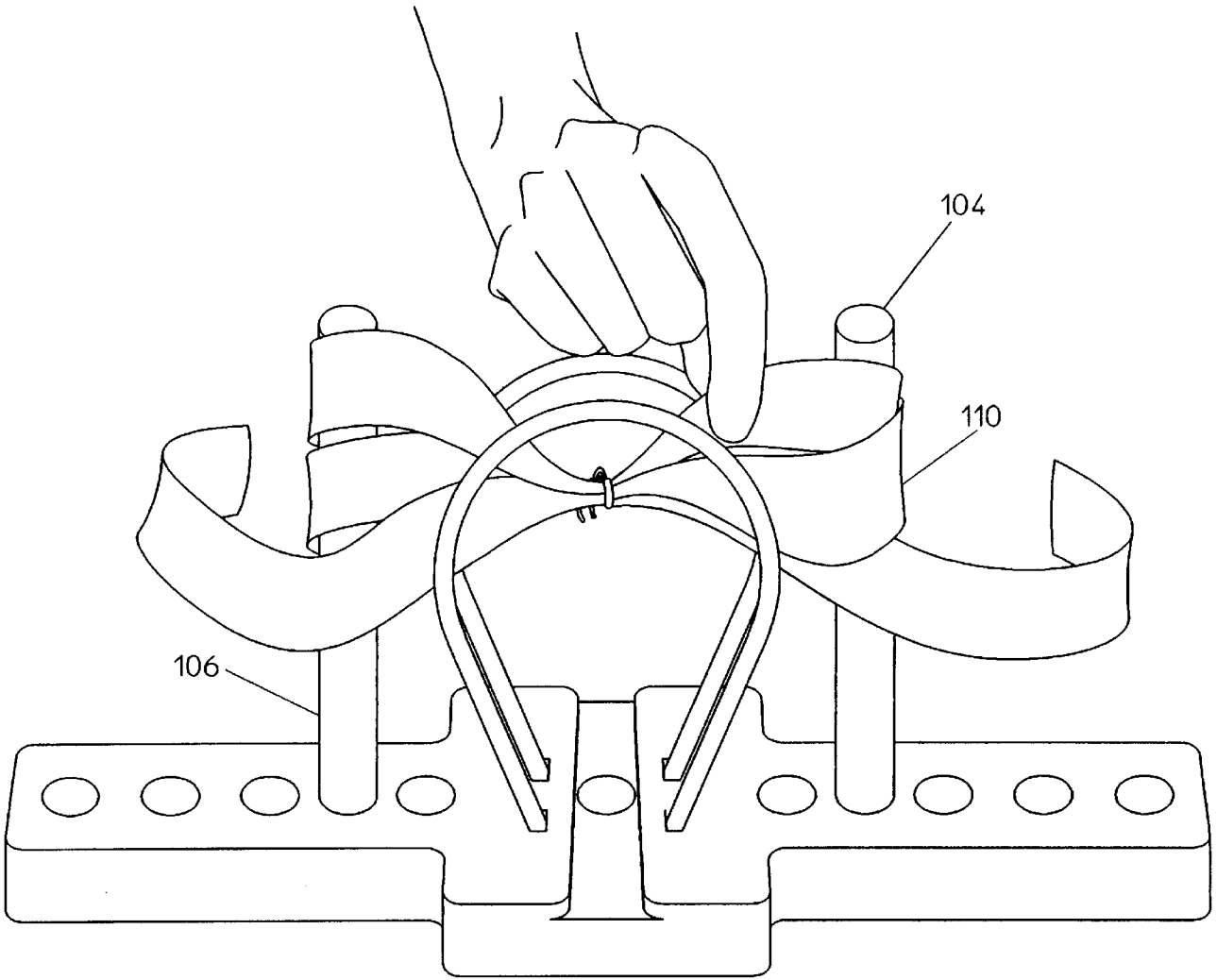
Figure 9:
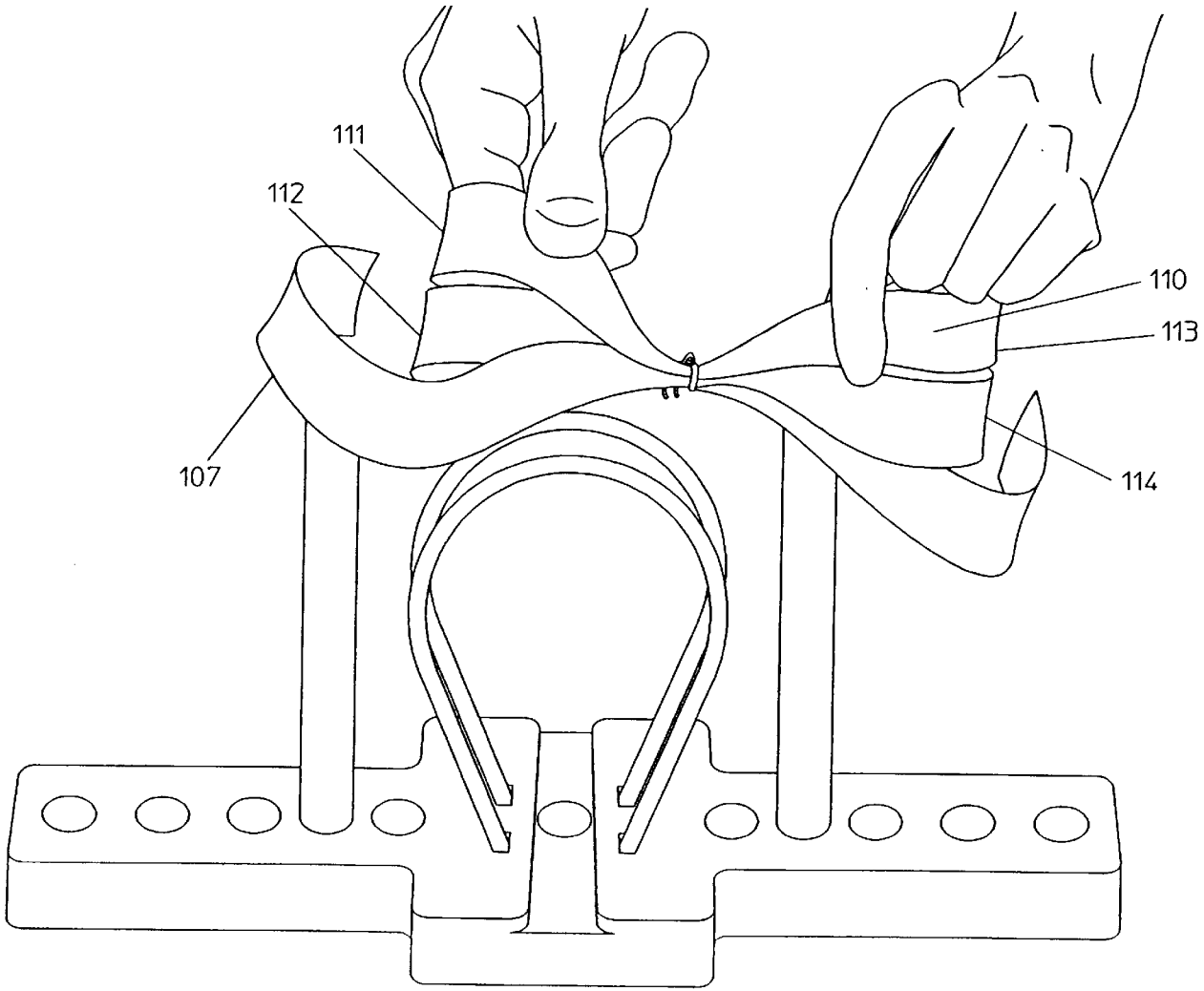

The preferred embodiment of the invention utilizes a plastic base 120 (FIGS. 10 through 13) molded from a type of Styrene plastic widely known as ABS with the configuration of openings indicated. The rods 103 & 104 and hoops 105 & 106 (see FIGS. 1 through 9) are inserted (for use in making bow or decoration) into base 120 in holes 121 through 130 for rods and 131 through 134 for hoops. Hole 135 is utilized in certain embodiments for inserting a central rod or for passing tie wire around ribbon center and thence through base prior to twisting tie wire to form fastening for bow or decoration. The hoops are each fabricatd from an elongated strap of metal or plastic, the formation of which into a hoop, similar to the familiar shape of a basketball hoop, allow a predetermined but firm flexure in the planes perpendicular to the plane in which the hoop shape is formed, causing a moderate holding pressure to be exerted on winds of ribbon or the like when wound around the rods. The preferred embodiment also utilizes high density polyethylene (HDPE) extruded into round tubes 10 mm in diameter and 165 mm in length for use as rods 103 & 104 and is extruded into rectangular cross-sections of approximately 3 by 8 mm and 380 mm length for use as hoops 105 & 106.

The descriptions of drawings in FIGS. 1 through 9 illustrate the steps used to make a bow comprised of 4 loops and two tails. Numerous other styles and constructions of bows and decorations are possible. Hoops 105 & 106 serve the purpose of keeping the ribbon under control as it is being formed into a bow or decoration. The hoops 105 & 106 used in conjunction with the variable positioning of rods 103 & 104 is the essence of the invention. This means of controlling the ribbon while a bow or decoration is being formed allows even a novice to make bows and decorations which are of a high standard acceptable to professionals in the fields in which bows and decorations are used.

Here is a description of the process of using the invention to make a 4 loop bow. Place a length of tie wire 100 in slot 101, which is used as a positioning guide for tie wire; then place ribbon 102 in front of rods 103 & 104 and within hoops 105 & 106 (see FIG. 1). Staying inside hoops, now bring ribbon 102 around rods (see FIG. 2). Continue bringing ribbon around rods 103 & 104 again, keeping ribbon inside hoops 105 & 106 (see FIG. 3). Insure that ribbon 102 is smoothly & evenly wrapped around rods 103 & 104 (see FIG. 4). Cut ribbon 102 leaving desired lengths for bow tails 107 & 108 (see FIG. 5). At center point 109, press down on ribbon while bringing tie wire 100 up around center point (see FIG. 6). Twist tie wire 100 tightly (see FIG. 7). Slide Bow 110, formed by the above steps, up and off rods 103 & 104 (see FIG. 8). Shape loops 111 through 114 and tails 107 & 108 of Bow 110 (see FIG. 9). The openings in base 120 are 0.2 mm larger than the specified nominal sizes of the tubes used for rods and the straps used for hoops. Each of the openings contains four raised ribs known as cross ribs, each 0.2 mm extended from its surrounding surface in a line parallel to its axis, in order to ensure a firm (interference) flat between rods and hoops and the cross-ribs of their respective openings. This allows for discrepancies in cross-sectional dimensions for tubes and straps during manufacture from lot to lot. Bows and decorations of several sizes may be made using the invention by changing the position of the rods on the base. Thus rods can be inserted and removed and reinserted in various holes in order to set the distance apart of the rods to make the desired size of bow or decoration. Bow construction styles may consist of 2, 4, or 6 or more loops formed as described above. Also possible are constructions where a bow is fastened onto another bow. Thus, several layers of bows may be fastened together to make a more complex or elaborate bow or decoration. Inserting additional rods into holes allows the formation of more elaborate styles of bows consisting of more and differing sizes of loops as desired.

The base 120 and the rods 103 & 104 and hoops 105 & 106 can alternatively be made from wood or metal or numerous plastics. The sizes of these components can each be larger or smaller to suit particular needs.

Figure 10:
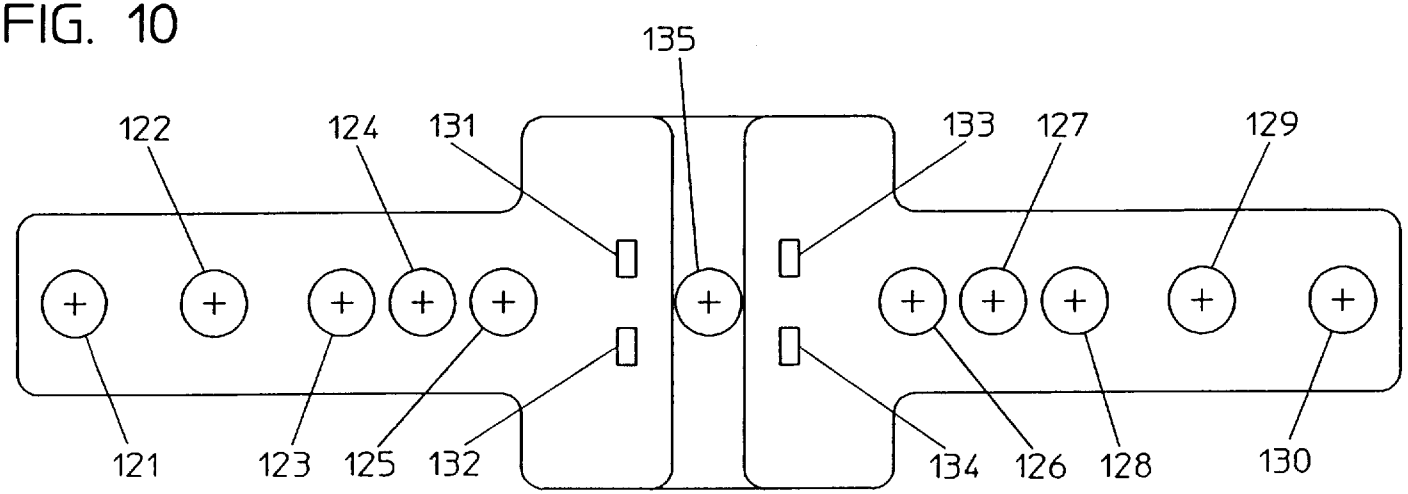
FIGS. 10 through 13 illustrate detailed views of the base of the invention device molded from plastic.
Figure 11:
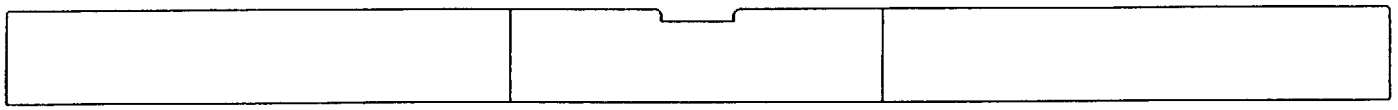
Figure 12:
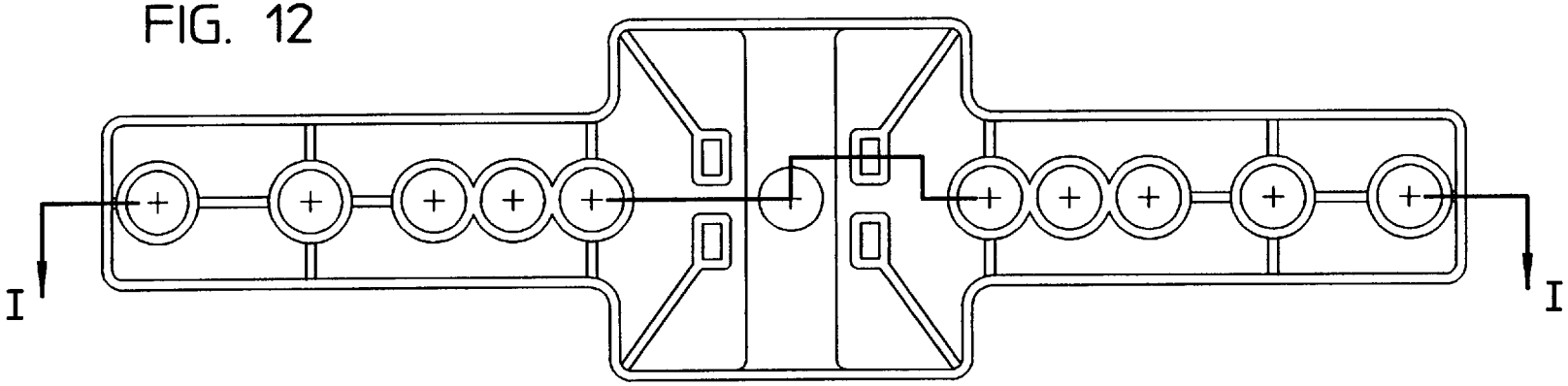
Figure 13:
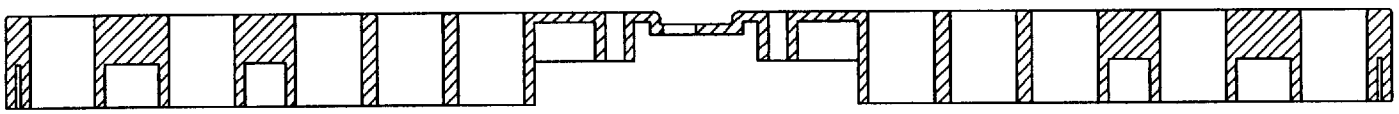

In the utilization of the invention to make bows with loops of several different sizes, more rods are inserted into openings 121 through 130 (see FIG. 10).

In order to make bows with center loops, place rods in center hole 135 and other holes as chosen. For example, to make a seven loop bow, wind ribbon around outer rods and behind center rod, while maintaining ribbon within hoops 105 & 106. Continue winding ribbon around rods and within hoops, keeping ribbon behind center rod for next turn around. Then, bring ribbon behind and around center rod loosely, and continue around next outer rod. Now, continue winding ribbon around rods and within hoops, keeping ribbon behind center rod for next turn around until ribbon tail is at opposite end from other tail. Now cut ribbon such that tails are equal. Place a length of 6 or more inches of tie wire half inside the tubular center rod. Gather all ribbon firmly at center from behind center rod and lift. As gathered ribbon is removed from bowmaker, tie wire which was inside tubular rod is pushed to rear meeting upper half of same and then firmly twisted two or more times to secure assembly of ribbon into bow. Finally, shape bow loops and tails into professionally acceptable seven loop decorative bow.

The hoops 105 & 106 (FIGS. 1 through 9) are used to control as many wraps of ribbon 102 around two or more rods as desired. The invention uses hoops as a "third hand" to hold the ribbon in place during the operation of the device, such that users need not have much dexterity. The use of hoops fabricated from plastic or metal or such, allows a thin cross-section member, when bent around in a hoop shape to resist deformation and provide a spring-like action without the need for springs or moving parts. Thus a minimal cross-section, flexible pair of opposing members can assist the operator with minimal interference during the bowmaking operation.

An alternative use for hoops 105 & 106 is to make gathered or puff types of decorations. For example to make a gathered "fan" style decoration, place tie wire 100, as in FIG. 1, then push a length of ribbon in transverse manner (that is, end-first, instead of side of ribbon) between hoops, creating gathers near one edge of ribbon resulting in construction that resembles an Oriental-style fan after tie wire is twisted around near the edge and resulting fan is removed from invention and shaped.

Other alternative products which may be made with use of invention are "Puffs" which are formed by taking two, three or more layers of ribbon and inserting transversely between hoops and gathering at center point or alternately near one edge and fastening with tie wire and thence puffing up by pulling layers apart to form "Puff" decoration.

Another alternate use is to make a "Fantasy" style bow with the invention. This is done by taking a die-cut tubular shape of fabric which is inserted around rods while keeping within hoops and then tying center with tie wire in fashion similar to that shown in FIG. 6 to form fantasy die-cut bow.

I claim:

1. A method of making a bow comprising the steps of winding a length of ribbon around, one or more times, a plurality of horizontally spaced perpendicular fixable rods while retaining each wind of the ribbon within a plurality of parallel hoops, which serve to hold said winds of ribbon in place, and then tying off the ribbon to form said bow by applying a tying means banded transversely around the wound ribbon, cinching and securing said tying means, and thereupon sliding said bow thus formed up and off the rods, and finally fanning and shaping the bow thus forming it into an aesthetically pleasing bow.

2. A bow making device comprising a base with a plurality of holes horizontally spaced, a plurality of movable solid or tubular rods which are vertically set into some of said horizontally spaced holes, and a plurality of hoops vertically set into said base, said hoops are each fabricated from an elongated strap of metal or plastic, the formation of which into a hoop allow a predetermined but firm flexure in the planes perpendicular to the plane in which the hoop shape is formed, causing a moderate holding pressure to be exerted on winds of ribbon when wound around a plurality of the rods, said hoops being parallel to each other and midway between and parallel to said rods, and whereupon said device is used to make a bow in which an operator simply winds a length of ribbon like around, one or more times, a plurality of said rods while retaining each wind of said ribbon within said hoops, and then tying off said ribbon into said bow through the application of a tying means banded transversely around the wound ribbon, whereupon said tying means is then cinched and secured, and thereupon sliding the bow thus formed up and off the rods, and finally fanning and shaping the bow and thus forming it into an aesthetically pleasing bow.

3. A bow making device comprising a base with a plurality of holes horizontally spaced, a plurality of movable solid or tubular rods which are vertically set into some of said horizontally spaced holes, and a plurality of hoops vertically set into said base, said hoops are each fabricated from an elongated strap of metal or plastic, the formation of which into a hoop allow a predetermined but firm flexure in the planes perpendicular to the plane in which the hoop shape is formed, causing a moderate holding pressure to be exerted on winds of ribbon when wound around a plurality of the rods, said hoops being parallel to each other and midway between and parallel to said rods, and whereupon said device is used to make a bow in which an operator simply inserts a length or a plurality of layered lengths of ribbon in a transverse manner to the base, between the hoops, and gathers or secures either in the center or near one edge of the ribbon to form puff and fan decorations, respectively.

* * * * *